United States Patent [19]

Oike

[11] Patent Number: 5,012,775

[45] Date of Patent: May 7, 1991

[54] TWO-CYCLE ENGINE

[75] Inventor: Ikuo Oike, Saitama, Japan

[73] Assignee: Honda Giken Kogyo Kabushiki Kaisha, Tokyo, Japan

[21] Appl. No.: 424,537

[22] Filed: Oct. 20, 1989

Related U.S. Application Data

[63] Continuation of Ser. No. 198,200, May 25, 1988, abandoned.

[30] Foreign Application Priority Data

Jul. 29, 1987 [JP] Japan ..... 62-189706

[51] Int. Cl.[5] ..... F02B 75/00

[52] U.S. Cl. ..... 123/192 B; 123/73 PP

[58] Field of Search ..... 123/192 R, 192 B, 198 E, 123/73 PP; 74/603, 604

[56] References Cited

U.S. PATENT DOCUMENTS

| | | | |
|---|---|---|---|
| 3,528,319 | 9/1970 | Ishida | 74/603 |
| 3,563,222 | 2/1971 | Ishida | 123/192 R |
| 3,563,223 | 2/1971 | Ishida | 123/192 B |
| 4,474,145 | 10/1984 | Boyesen | 123/73 PP |
| 4,554,894 | 11/1985 | Johnson | 123/198 E |
| 4,802,450 | 2/1989 | Roberts | 123/192 B |

*Primary Examiner*—Andrew M. Dolinar
*Assistant Examiner*—M. Macy
*Attorney, Agent, or Firm*—Lyon & Lyon

[57] ABSTRACT

A two-cycle engine having a crank shaft, a main transmission shaft and a balancer shaft in order to lower the center of gravity and to improve lead valve layout is provided with a casing structure containing an intake passage formed integrally with a crank chamber and a transmission chamber and wherein the intake passage is located in a portion of the casing above the axes of the crank shaft and the main shaft and the balancer shaft is located below such axes.

16 Claims, 4 Drawing Sheets

TWO-CYCLE ENGINE

This application is a continuation, of application Ser. No. 198,200, filed May 25, 1988 now abandoned.

BACKGROUND OF THE INVENTION

The present invention relates to a two-cycle engine and, more particularly, to a two-cycle engine employing a balancing shaft and wherein an engine casing is provided in which an intake passage, a crank chamber and a transmission chamber are integrally formed.

A large number of two-cycle engines carried by vehicles, such as motorcycles, motor three wheelers, or the like, are provided with an engine casing in which an intake passage, a crank chamber and a transmission chamber are integrally formed. Such engines are also provided with a balancer shaft which is used for cancelling oscillations due to the reciprocatory movements of the pistons, the connecting rod, or the like. In such two-cycle engines, as for example the one disclosed in Japanese Patent Laid-Open No. 62-13761 (No. 13761/1987), both of the intake passage and the balancer shaft are arranged above the line which connects the axis of the crank shaft with the axis of the main shaft of the transmission mechanism in which the power of the crank shaft is input to the axis of the main shaft. Consequently, the conventional structure of these engines is not intended to lower the center of gravity of the engine. Also, in such engines incorporating a structure wherein reed valve is located in the intake passage, because of the problem of balancer shaft interference with the reed valve, limitations are imposed when designing the reed valve.

SUMMARY OF THE INVENTION

The present invention is devised in light of the aforementioned circumstances and, accordingly, has as an object to provide a two-cycle engine in which the center of gravity of the engine can be lowered, without impeding the layout, or accommodation of the reed valve.

In order to attain such object, there is provided, according to the present invention, an intake passage arranged in the engine casing above the line connecting the axis of the crank shaft with the axis of the main shaft, while the balancer shaft is arranged below this line.

Practice of the present invention results in a lowering of the center of gravity of the engine and facilitates the layout of the reed valve.

For a better understanding of the invention, its operating advantages and the specific objectives obtained by its use, reference should be made to the accompanying drawings and description which relate to the preferred embodiments thereof.

DETAILED DESCRIPTION OF THE PREFERRED EMBODIMENTS

Figure 1:
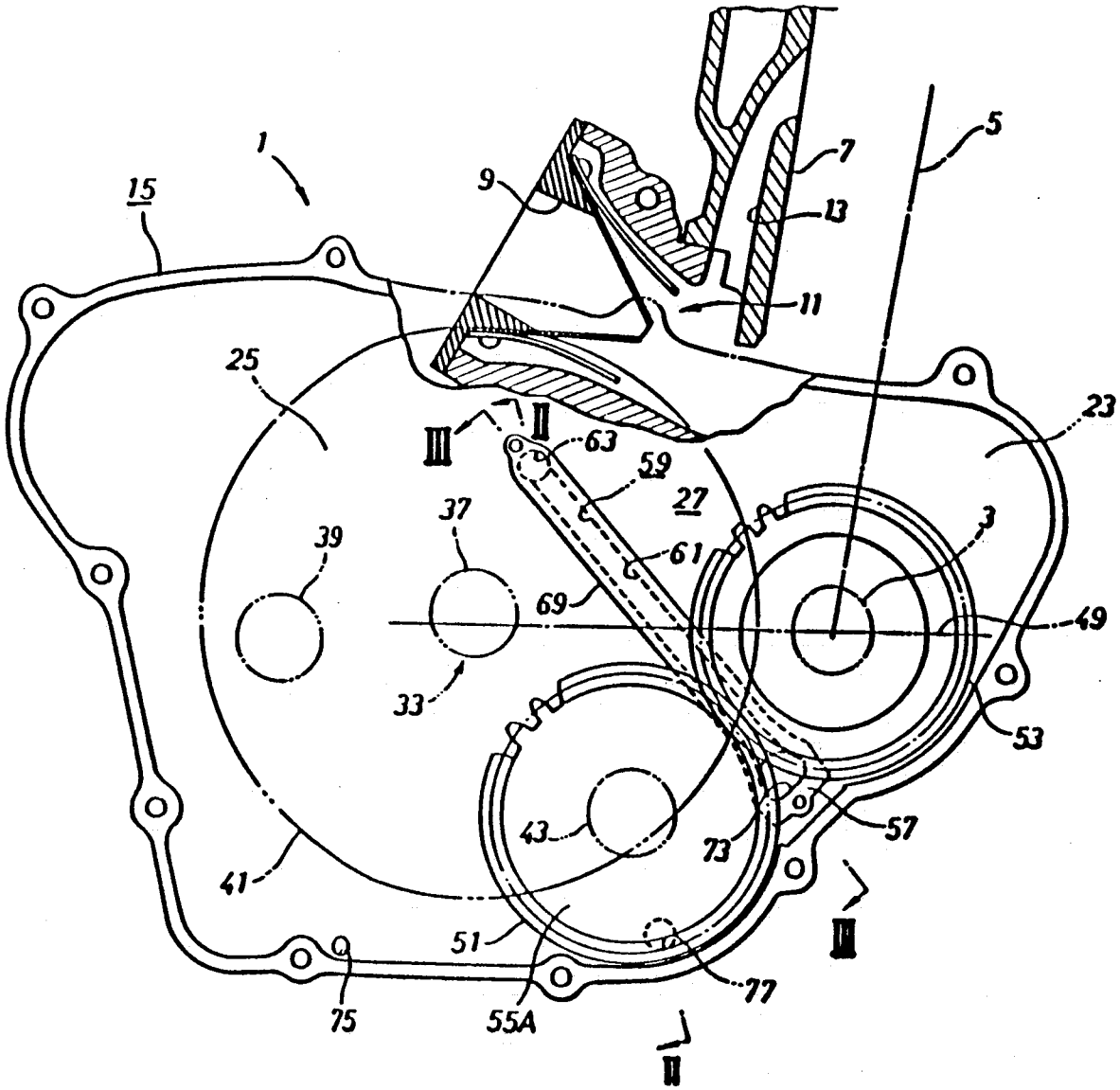
FIG. 1 is a sectional elevational view illustrating essential parts of the engine casing of the present invention.

The drawing figures illustrate at 1 a two-cycle engine, at 3 a crank shaft, at 5 a cylinder axis, at 7 a cylinder, at 9 an intake passage, at 11 a reed valve, at 13 an exhaust passage and at 15 an engine casing. The engine casing 15 (FIG. 2) comprises a casing body 17, and side covers 19 and 21 which are attached to the left and right sides, respectively, of the casing body 17. A crank chamber 23 is defined in the front portion of the engine casing 15 and a transmission chamber 25 is defined in the rear portion of the crank chamber 23. Also, a side chamber 27 is defined by a left side cover 19 and the left side wall of the casing body 17, and a balancer chamber 29 is defined by a right side cover 21 and the right side wall of the casing body 17. Lubricant oil is stored in the transmission chamber 25, the side chamber 27 and the balancer chamber 29.

In the chamber 25 is arranged a transmission mechanism 33 that is provided with a main shaft 37 on which are mounted a plurality of reduction gears 35 and a counter shaft 39. Power generated by the crank shaft 3 is input to the main shaft 37 through the intermediary of a clutch 41 arranged in the side chamber 27. The intake passage 9 is formed in the upper portion of the engine casing above a phantom line 49 which connects the axis of the crank shaft 3 with the axis of the main shaft 37. Reference numeral 43 indicates a balancer shaft which is rotatably supported by bearings 45 and 47 incorporated into the casing body 17. The balancer shaft 43 is arranged below the phantom line 49. To the left end of the balancer shaft 43 is attached a driven gear 51 with the drive gear 53 of the crank shaft 3 in the side chamber 27 which serves as a balancer 55A. To the right end of the balancer shaft 43 is provided a balancer 55B which is contained in the balancer chamber 29.

In the portion of the side chamber 27, where the drive gear 53 and the driven gear 51 mesh with each other, is formed a pressure chamber 57 in which the lubricant oil is collected by the toothed portions of the gears 51 and 53 and the pressure thereof increased. The pressure chamber 57 is defined by a side wall portion 19A and a bottom wall portion 19B of the left side cover 19, and a side wall portion 17A and a bottom wall portion 17B of the casing body 17.

Reference numeral 59 indicates an oil passage that communicates the transmission chamber 25 with the pressure chamber 57. Passage 59 is provided with a longitudinal portion 61 which extends substantially vertically and a portion 63 extending in the transverse direction. The longitudinal portion 61 of the oil passage 59 comprises a groove 65 formed in the casing body 17 and a plate-like piece 69 attached to the casing body by a threaded screw 67 to cover the groove 65. The transverse portion 63 of the passage 59 contains appropriately positioned holes 71 for supplying oil to the parts to be lubricated.

An opening 73 is provided in the cover piece 69 to communicate pressure chamber 57 with the lower end of the longitudinal portion 61. An oil passage 75 communicates the bottom portion of the transmission chamber 25 with the bottom portion of the side chamber 27. Also, the bottom portion of the balancer chamber 29 is adapted to communicate with the bottom portion of the side chamber 27 through the opening at 77 disposed adjacent the driven gear 51.

The present embodiment, constructed as described above, advantageously lowers the center of gravity of the engine, and in the disposition of the reed valve 11, the latter suffers no restriction from the balancer shaft 43 thereby enhancing the layout of the reed valve 11.

Figure 2:
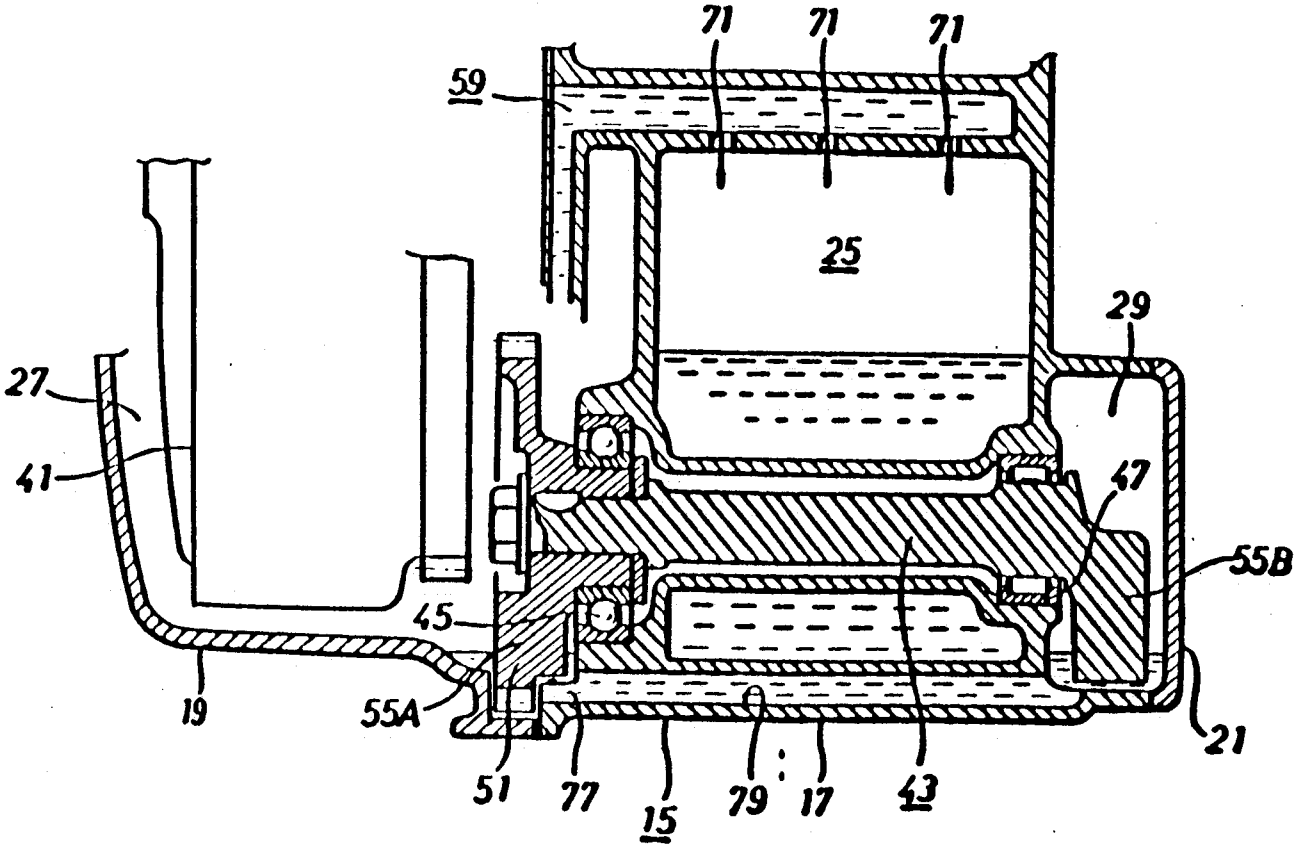
FIGS. 2 and 3 are sectional views taken along line II—II and III—III, respectively, in FIG. 1.
Figure 3:
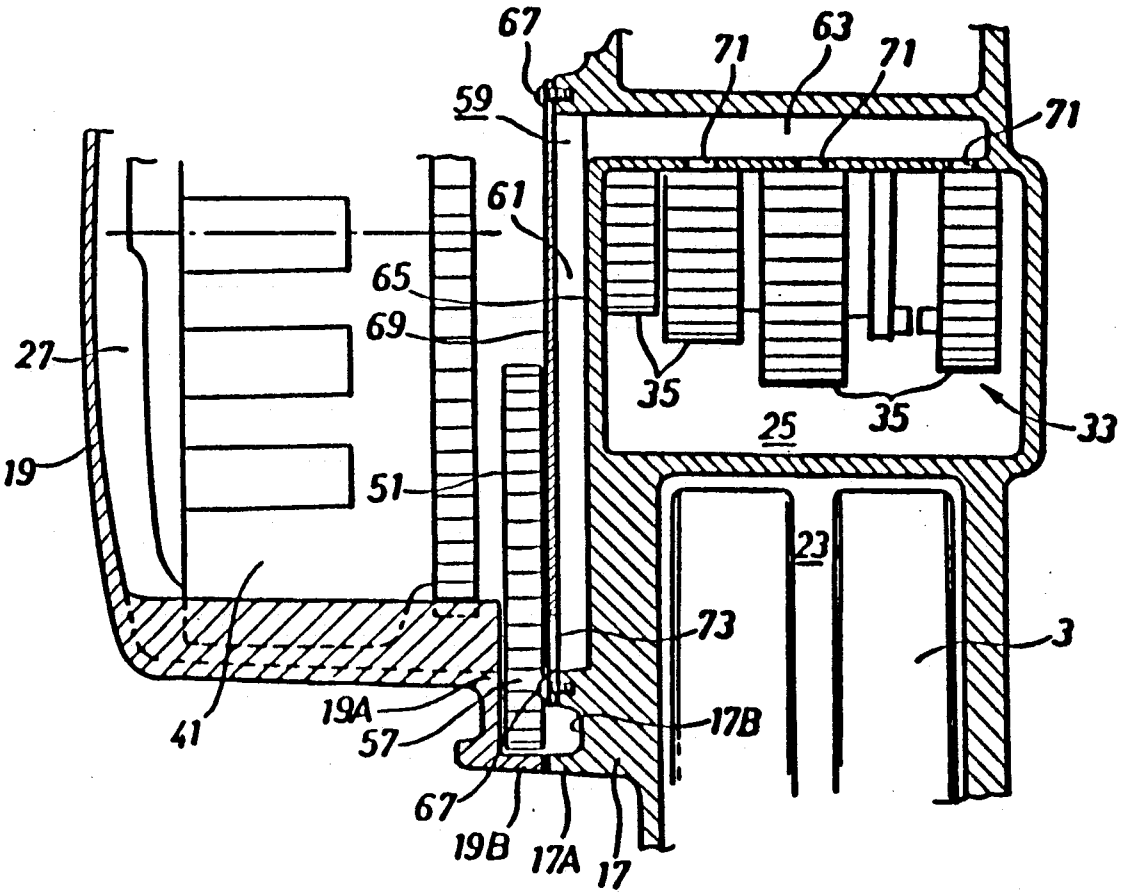

As a result of the described arrangement, during operation of the engine, the lubricant oil collected in the side chamber 27 is supplied under pressure from the pressure chamber 57 to the reduction gears 35 in the transmission chamber 25 through the intermediary of the opening 73, the oil passage 59 and the hole 71, whereby the lubrication of the transmission mechanism 33 is improved. Also, because the lubricant oil is supplied from the described pressure chamber to the transmission chamber 25, as shown in FIG. 2, the oil level in the transmission chamber 25 is increased while being lowered in the side chamber 27 and the balancer chamber 29. Therefore, according to the present invention, the efficiency of lubrication of the transmission mechanism 33 is increased. Moreover, it is possible to arrange the balancer shaft 3 at the lower position in order to lower the center of gravity of the engine while, at the same time, reducing the loss of power resulting from the stirring resistance of the balancer 55 in the body of lubricant oil.

Although the described embodiment is adapted to incorporate two balancers on the portion out of the web portion of the crank shaft 3 on the balancer shaft 43, one balancer may be provided at a position opposing to the web portion.

Figure 4:
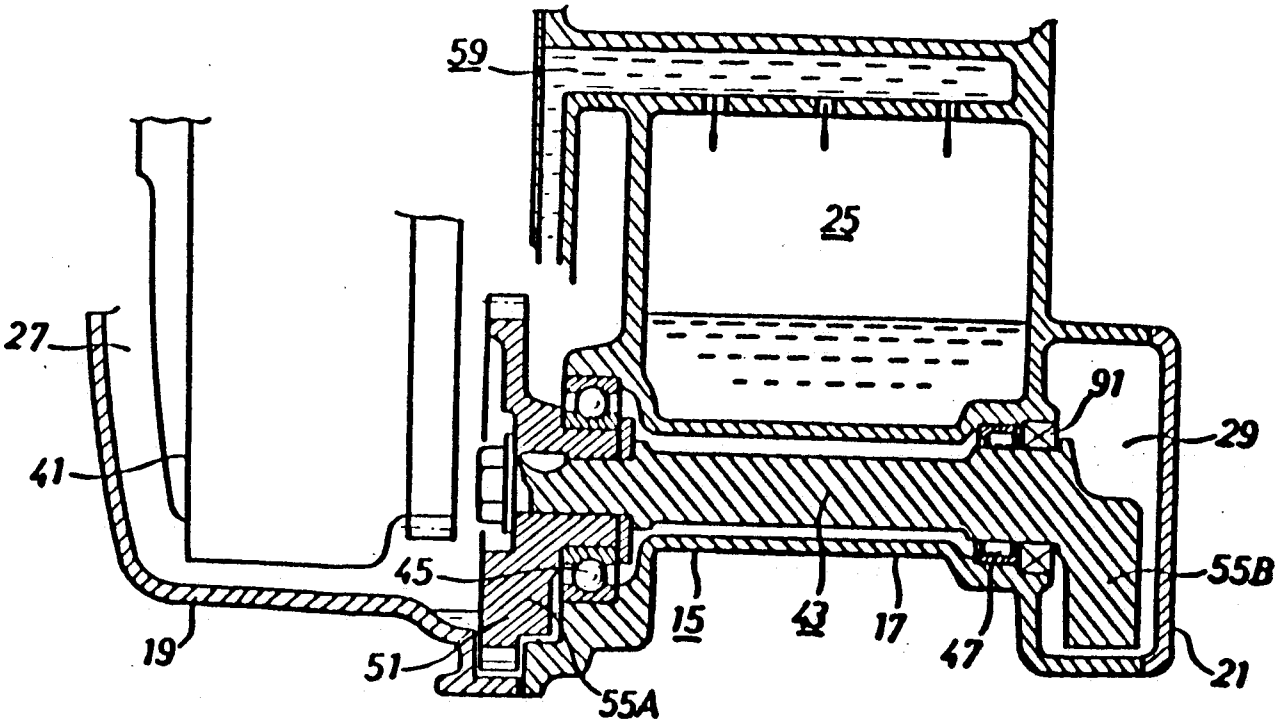
FIG. 4 is a view similar to FIG. 2 illustrating a second embodiment of the present invention.

FIG. 4 illustrates a second embodiment of the present invention in which the balancer chamber 29 and the side chamber 27 are separated by a seal member 91 and lubricant oil is not stored within the balancer chamber 29. By means of this arrangement the stirring resistance of a balancer 55B in a body of lubricant oil is totally eliminated. This second embodiment of the invention otherwise has the same function and effect as the first embodiment; that is, it operates to lower the center of gravity of the engine 1 and is advantageous in the layout of the reed valve 11.

As is apparent from the above description, the present invention provides a two-cycle engine having the advantage of a lowered center of gravity and an improved layout of the reed valve.

It should be further understood that, although preferred embodiments of the invention have been illustrated and described herein, changes and modifications can be made in the described arrangements without departing from the scope of the appended claims.

I claim:

1. A two-cycle engine comprising:

a engine casing containing an integrally formed intake passage, a crank chamber and a transmission chamber, a transmission mechanism having a main shaft in said transmission chamber;

a crank shaft in said crank chamber for driving said main shaft;

a balancer shaft having a driven gear;

a drive gear mounted on said crank shaft for meshing engagement with said driven gear;

a side chamber in said engine casing housing said drive gear and said driven gear, including a pressure chamber containing meshing portion of said drive gear and said driven gear whereby the pressure of lubricant oil supplied to said engine is increased; and means for conducting pressurized lubricating oil from said pressure chamber to a point of use.

2. A two-cycle engine according to claim 1 in which said balancer shaft is disposed below a level corresponding to that of both the axis of said crank shaft and of the axis of said main shaft.

3. The two-cycle engine according to claim 2 including clutch means in said side chamber operative to drivingly connect said crank shaft and said main shaft.

4. The two-cycle engine according to claim 2 including a balancer chamber containing said balancer shaft; and seal means for separating said balancer chamber from said side chamber.

5. The two-cycle engine according to claim 2 including an oil passage extending from said pressure chamber to said transmission chamber for supplying lubricant oil thereto.

6. The two-cycle engine according to claim 5 wherein said oil passage includes a portion extending substantially vertically from said pressure chamber and a transverse portion extending substantially laterally to said transmission chamber.

7. The two-cycle engine according to claim 6 wherein said vertically extending portion of said oil passage comprises a groove formed in said engine casing; and plate means attached to said engine casing and covering said groove.

8. The two-cycle engine according to claim 7 wherein said transverse portion of said oil passage contains a plurality of appropriately positioned holes for supplying lubricant oil to said transmission chamber.

9. The two-cycle engine according to claim 7 wherein said plate means contains a first opening for the supply of lubricant oil from said pressure chamber to said oil passage and a plurality of holes for communicating said transverse passage with said transmission chamber whereby lubricant oil is supplied from said side chamber to said transmission chamber.

10. A two-cycle engine according to claim 1 including clutch means in said side chamber operative to drivingly connect said crank shaft and said main shaft.

11. The two-cycle engine according to claim 1 including a balancer chamber containing said balancer shaft; and seal means for separating said balancer chamber from said side chamber.

12. The two-cycle engine according to claim 1 including an oil passage extending from said pressure chamber to said transmission chamber for supplying lubricant oil thereto.

13. The two-cycle engine according to claim 12 wherein said oil passage includes a portion extending substantially vertically from said pressure chamber and a transverse portion extending substantially laterally to said transmission chamber.

14. The two-cycle engine according to claim 13 wherein said vertically extending portion of said oil passage comprises a groove formed in said engine casing; and plate means attached to said engine casing and covering said groove.

15. The two-cycle engine according to claim 14 wherein said transverse portion of said oil passage contains a plurality of appropriately positioned holes for supplying lubricant oil to said transmission chamber.

16. The two-cycle engine according to claim 14 wherein said plate means contains a first opening for the supply of lubricant oil from said pressure chamber to said oil passage and a plurality of holes for communicating said transverse passage with said transmission chamber whereby lubricant oil is supplied from said side chamber to said transmission chamber.

* * * * *